United States Patent [19]

Fanelli

[11] Patent Number: 4,896,434

[45] Date of Patent: Jan. 30, 1990

[54] APPARATUS AND METHOD FOR DRYING GEL

[76] Inventor: Joseph Fanelli, 2300 Saddleback Dr., Danville, Calif. 94526

[21] Appl. No.: 269,693

[22] Filed: Nov. 10, 1988

[51] Int. Cl.[4] ..... F26B 3/34

[52] U.S. Cl. ..... 34/1; 34/17; 34/15; 34/92

[58] Field of Search ..... 34/1-17, 34/60, 90, 92

[56] References Cited

U.S. PATENT DOCUMENTS 2,555,450 6/1951 Lee ..... 34/1

4,720,924 1/1988 Hradecky et al. ..... 34/1

*Primary Examiner*—Henry A. Bennet

*Assistant Examiner*—John Sollecito

*Attorney, Agent, or Firm*—Michael Kroll

[57] ABSTRACT

An improved apparatus for drying gel is provided and consists of a tray assembly having a surface on which the gel is disposed, a microwave oven for applying microwave energy to the gel in the tray assembly to uniformly dry the gel and a vacuum pump assembly for applying a vacuum to the tray assembly for removing water vapor therefrom during the drying of the gel.

4 Claims, 1 Drawing Sheet

APPARATUS AND METHOD FOR DRYING GEL

BACKGROUND OF THE INVENTION

1. Field of the Invention

The instant invention relates generally to gel drying arrangements and more specifically it relates to an improved apparatus for drying gel.

2. Description of the Prior Art

Numerous gel drying arrangements have been provided in prior art that are adapted to non-uniformly dry gel such that it takes a relatively long period of time for complete drying of the gel. While these units may be suitable for the particular purpose to which they address, they would not be as suitable for the purpose of the present invention as heretofore described.

SUMMARY OF THE INVENTION

A primary object of the present invention is to provide an improved apparatus for drying gel that will overcome the shortcomings of the prior art devices.

Another object is to provide an improved apparatus for drying gel that will gently, quickly and completely dry the gel.

An additional object is to provide an improved apparatus for drying gel whereby the gel is processed under precisely controlled temperature and atmosphere conditions.

A further object is to provide an improved apparatus for drying gel that utilizes dry heat and reduced pressure to rapidly dehydrate and affix the gel to a medium of choice, facilitating storage and/or processing.

A still further object is to provide an improved apparatus for drying gel that utilizes a microwave oven which can dry gel, heat a liquid, melt agarose and perform other common laboratory procedures.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
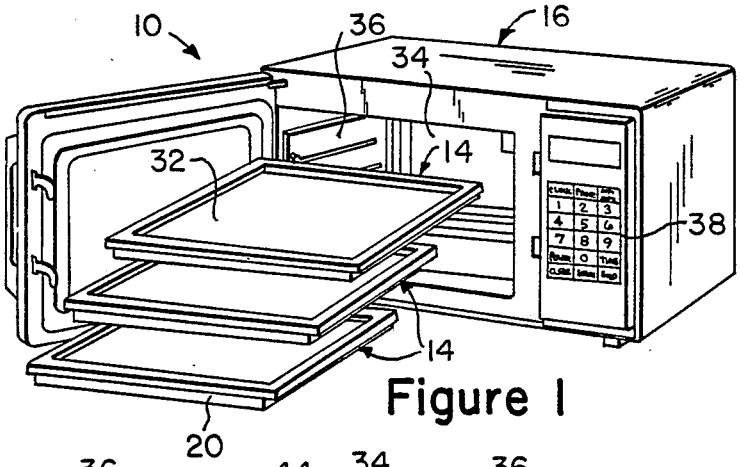
FIG. 1 is a perspective view of the invention with the tray assemblies pulled out of the microwave oven.
Figure 3:
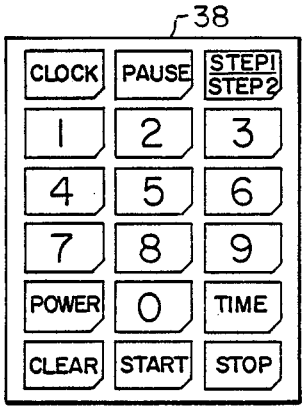
FIG. 3 is an enlarged front elevational view of the keyboard on the microwave oven.
Figure 2:
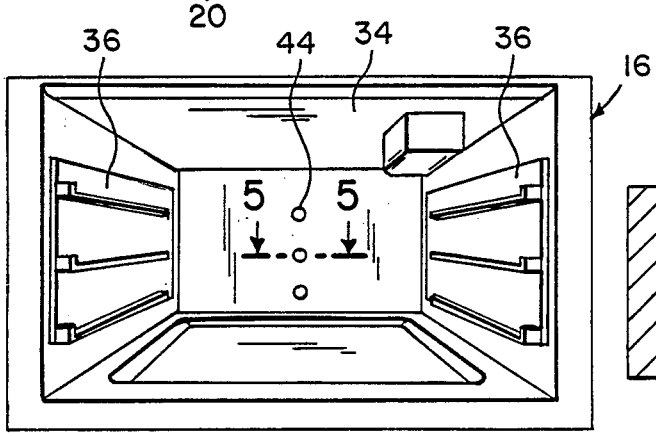
FIG. 2 is a perspective view of the oven compartment of the microwave oven.
Figure 5:
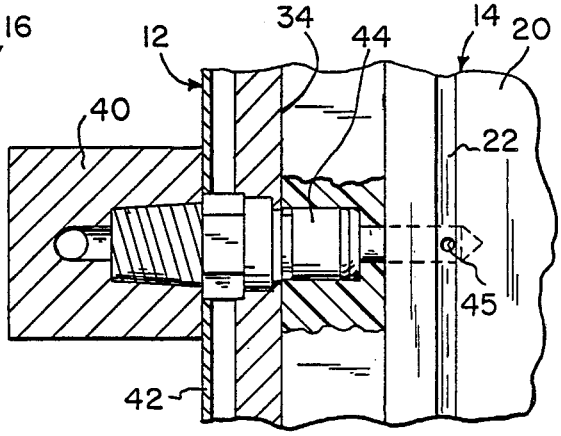
FIG. 5 is an enlarged cross sectional view with parts broekn away taken along line 5—5 in FIG. 2 with one of the trays therein.
Figure 4:
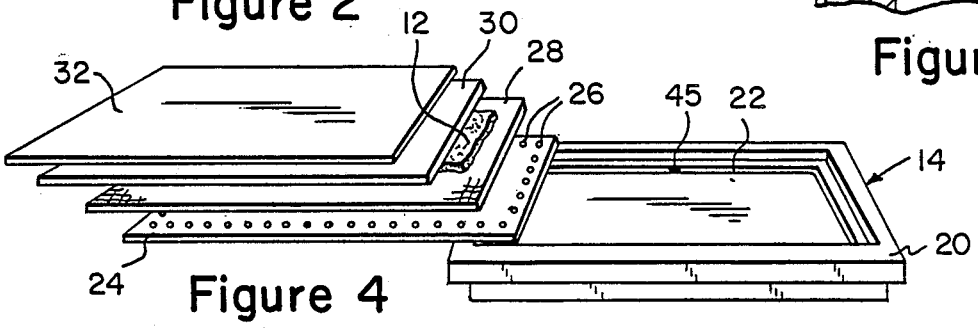
FIG. 4 is an exploded perspective view of one of the tray assemblies.
Figure 6:
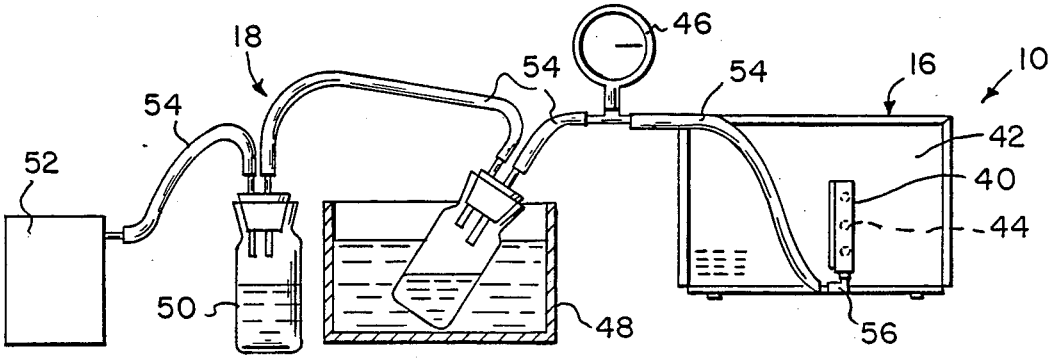
FIG. 6 is a rear view of the microwave oven with the vacuum pump assembly attached to the manifold.

Turning now descriptively to the drawings, in which similar reference characters denote similar elements throughout the several views, FIGS. 1 through 6 illustrate an improved apparatus 10 for drying gel 12 consisting of a tray assembly 14, a microwave oven 16 and a vacuum pump assembly 18. The tray assembly 14 has a surface on which the gel 12 is disposed. The microwave oven 16 is for applying microwave energy to the gel 12 in the tray assembly 14 to uniformly dry the gel. The vacuum pump assembly 18 is for applying a vacuum to the tray assembly 14 for removing water vapor therefrom during the drying of the gel 12. The tray assembly 14 with the gel 12 are placed into the microwave oven 16 so that the vacuum pump assembly 18 can be in flow communication with the tray assembly 14 within the microwave oven.

The tray assembly 14 includes a tray 20 that has a groove 22 around its perimeter. A support plate 24 has a plurality of holes 26 around its perimeter and is disposed within the tray 20 so that the holes 26 are aligned with the groove 22 in the tray 20 for collecting the water vapor draining through the holes 26 during drying of the gel 12. A piece of water soaked filter paper 28 is disposed over the support plate 24 so that the gel 12 can be placed onto the filter paper 28. A polyethylene sheet 30 is disposed over the filter paper 28. A rubber sheet 32 is disposed over the polyethylene sheet 30 for forming a vacuum seal.

The microwave oven 16 further includes an oven compartment 34 and a track 36 within the oven compartment 34 for receiving up to three tray assemblies 14 therein. A keyboard 38 is provided on the microwave oven 16 for operating the oven compartment 34. A manifold 40 at rear 42 of the microwave oven 16 is in flow communication with the vacuum pump assembly 18. The manifold 40 has three fittings 44, extending into the oven compartment 34 to connect with bore 45 of each groove 22, in each tray 20, when the tray assemblies 14 are placed into the tracks 36.

The vacuum pump assembly 18 includes an inline vacuum gauge 46, a condensation trap 48, an acid trap 50 for liquids and organics and a vacuum pump 52. Four lengths of tubing 54 are for connecting the vacuum gauge 46 to the manifold via an elbow 56, the vacuum gauge 46 to the condensation trap 48, the condensation trap 48 to the acid trap 50 and the acid trap 50 to the vacuum pump 52.

Basically one layer is the gel to be dried and the second layer is filter paper which affords the dried thin gel a structural support so that the dried gel may be easily handled, that is the filter paper ats as a reinforcement member.

LIST OF REFERENCE NUMBERS

10 drying apparatus
12 gel
14 tray assembly
16 microwave oven
18 vacuum pump assembly
20 tray
22 groove in tray
24 support plate
26 holes in support plate
28 filter paper
30 polyethylene sheet
32 rubber sheet
34 oven compartment
36 track
38 keyboard
40 manifold
42 rear of the microwave oven

44 fittings
45 bore in groove
46 inline vacuum gauge
48 condensation trap
50 acid trap
52 vacuum pump
54 four lengths of tubing
56 elbow It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved apparatus for drying gel which comprises:

(a) a tray assembly having a surface on which the gel is disposed, said tray assembly including a tray having a groove around its perimeter, a support plate having a plurality of holes around its perimeter, said support plate disposed within said tray so that said holes of said support plate are aligned with said groove in said tray for collecting the water vapor draining through said holes during drying of the gel, a piece of water soaked filter paper disposed over said support plate so that the gel can be placed onto said filter paper, a polyethylene sheet disposed over said filter paper, and a rubber sheet disposed over said polyethylene sheet for forming a vacuum seal;

(b) a microwave oven for applying microwave energy to the gel in said tray assembly to uniformly dry the gel in said tray assembly, and (c) means for applying a vacuum to said tray assembly for removing moisture evaporated from the gel during the drying of the gel by said microwaves, said microwave oven being fully closable for directing the microwaves generated by said microwave oven.

2. An improved apparatus for drying gel as recited in claim 1, wherein said vacuum means includes a vacuum pump assembly in flow communication with said tray assembly within said microwave oven.

3. An improved apparatus for drying gel as recited in claim 2, wherein said microwave oven further includes:

(a) an oven compartment;

(b) a track within said oven compartment for receiving said tray assembly therein;

(c) a keyboard for operating said oven compartment; and (d) a manifold at rear of said microwave oven connected to said vacuum pump assembly, said manifold having a fitting extending into said oven compartment to connect with said groove in said tray when said tray assembly is placed into said track.

4. An improved apparatus for drying gel as recited in claim 3, wherein said vacuum pump assembly includes:

(a) an inline vacuum gauge;

(b) a condensation trap;

(c) an acid trap for liquids and organics;

(d) a vacuum pump; and (e) four lengths of tubing for connecting said vacuum gauge to said manifold, said vacuum gauge to said condensation trap, said condensation trap to said acid trap and said acid trap to said vacuum pump.

* * * * *